US007445061B1

(12) United States Patent
Falgout, Sr. et al.

(10) Patent No.: US 7,445,061 B1
(45) Date of Patent: Nov. 4, 2008

(54) MOTOR SHAFT SECURITY APPARATUS

(76) Inventors: Thomas E. Falgout, Sr., 110 Charles Read St., Lafayette, LA (US) 70503; Chad M. Daigle, 501 Hidden Acres Dr., Lafayette, LA (US) 70503

( * ) Notice: Subject to any disclaimer, the term of this patent is extended or adjusted under 35 U.S.C. 154(b) by 82 days.

(21) Appl. No.: 11/080,095

(22) Filed: Mar. 14, 2005

(51) Int. Cl.
*E21B 4/00* (2006.01)

(52) U.S. Cl. ..... 175/106

(58) Field of Classification Search ..... 175/107, 175/104, 106
See application file for complete search history.

(56) References Cited

U.S. PATENT DOCUMENTS 3,840,080 A 10/1974 Berryman
4,308,927 A * 1/1982 Fox ..... 175/107
4,811,798 A 3/1989 Falgout
6,540,020 B1 4/2003 Falgout

* cited by examiner

*Primary Examiner*—Jennifer H Gay
*Assistant Examiner*—Daniel P Stephenson
(74) *Attorney, Agent, or Firm*—John D. Jeter

(57) ABSTRACT

A bearing assembly is situated to conduct axial forces between the general housing and the output shaft by way of an intermediate sleeve that is secured to the output shaft outside the general housing and is axially confined by a bearing assembly secured to the general housing.

9 Claims, 2 Drawing Sheets

MOTOR SHAFT SECURITY APPARATUS

This invention pertains to down hole motors. More particularly, it pertains to structure that secures the motor as a single assembly, for recovery from a well bore, if some parts fail. The novel structure enhances the ability of the motor to withstand jarring stresses produced by drill string mounted jarring apparatus.

BACKGROUND OF THE INVENTION

Drilling motors are used as part of a drill string, near the drill head, to drive the drill head rotationally relative to the upwardly continuing drill string. The drilling fluid flow is usually used to power the motor.

Drilling motors are often used on coiled tubing which cannot be rotated. In some cases the motor is used to rotationally attach the drill string to hardware down hole that is to be recovered by tension forces. Jars are sometimes used to deliver shock to the hardware. Motors that are designed for drilling are sometimes not designed to accept axial shock forces.

Motors used for drilling in open holes drive bits that can become stuck in the hole and require axial thrust along the drill string for recovery. Jars can provide shock to the stuck bit to free a bit not recoverable without jars. To benefit from the application of jars, motors need to withstand the shock applied.

Axial shock loads imposed upon motors can separate their output drive shafts. The usual structure of motors includes capture rings that will extract all of the output shaft when the damaged motor is removed from the well. The separation experience, however, ends the usefulness of the motor as a rotational drive, until it is removed and repaired. There is a need for apparatus in the motor to accept shock loads, even if the motor is not running when the shock loads are applied, yet allow the motor to continue in service when the shock loads are no longer being applied.

SUMMARY OF THE DISCLOSURE

A sleeve is threadedly secured to the projecting end of the output shaft and extends into the motor housing, past the lower end of the thrust bearing assembly, to load a selected amount of bearings independently of the upwardly extending arbor of the output shaft. The output shaft is suspended in the general housing on bearings directly engaging the extended end of the output shaft. Axial forces imposed upon the general housing are transmitted to the projecting end of the output shaft without passing through the weaker part of the output shaft.

These and other objects, advantages, and features of this invention will be apparent to those skilled in the art from a consideration of this specification, including the attached claims and appended drawings.

DETAILED DESCRIPTION OF DRAWINGS

In the down hole motor art, a general housing may consist of several parts. In function, however, the assembled general housing attaches to a drill string, supports a confined motor and has a lower bearing housing which forms a housing closure from which an output shaft extends to engage and drive a drill bit.

Figure 1:
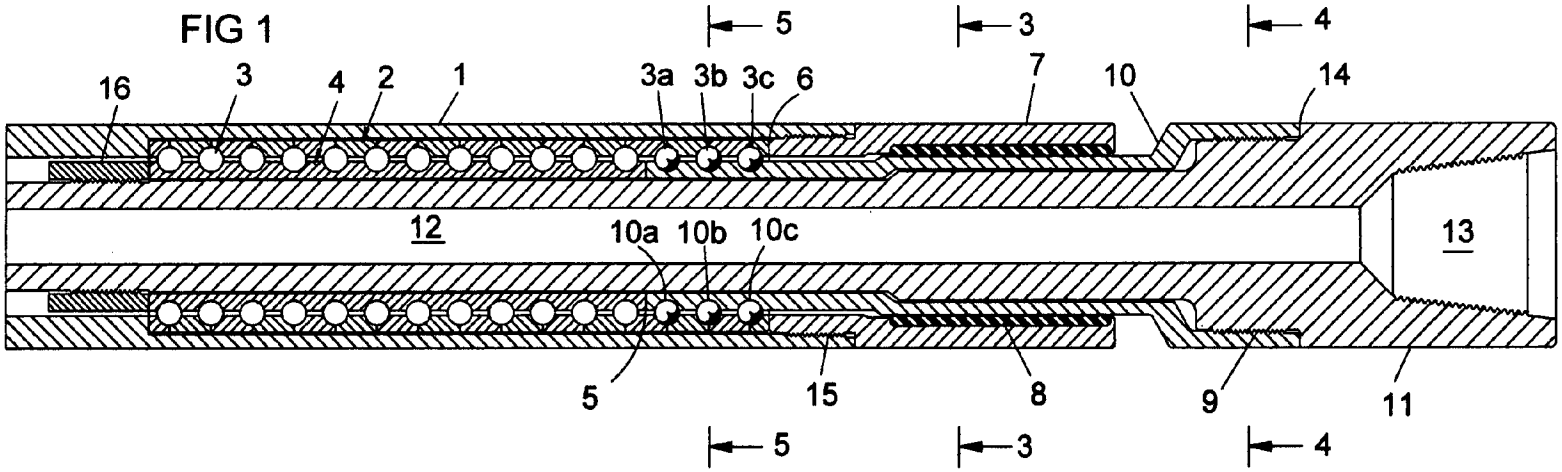
FIG. 1 is a side view, in cut-away, of the preferred embodiment of the invention.
Figure 2:
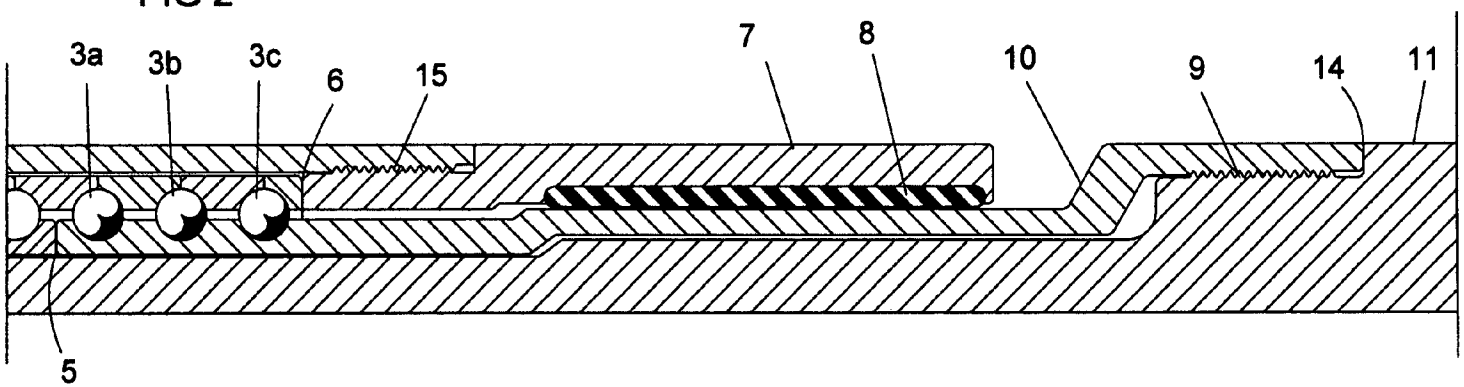
FIG. 2 is an enlarged, fragmented, area of the apparatus of FIG. 1.

FIGS. 1 and 2 show the lower end of a drilling motor. No power producing structure is shown. A power producing assembly is normally situated in the upper end of tube 1, above the limit of FIG. 1, and drives the output shaft through an attachment situated above (left of) nut 16. Body housing 1 is threadedly attached to lower bearing housing 7 by threads 15. The body housing compresses bearing outer race stack 2 which forms races 3, in conjunction with inner race stack 4, for bearing balls. Bearing balls such as 3*a*, 3*b*, and 3*c* normally occupy the races 3.

Security sleeve 10 is supported in the housing by bearing ball sets 3*a*, 3*b*, and 3*c* by way of race grooves in the sleeve 10. Radial bearing 8 is shown as a rubber part in lower bearing housing 7. There are several types of radial bearings, including composite and metal, and selection depends upon the nature of intended motor use.

The secured sleeve 10 is threadedly attached by threads 9 to the major dimension of the motor output shaft 11, abutting at juncture 14. The motor output shaft 11 is retained within the housing by nut 16 which compresses the inner bearing race assembly 4. Race assembly 4 abuts sleeve 10 at juncture 5. The lower three races containing ball sets 3*a*, 3*b*, and 3*c* are preferably situated to cooperate with other bearing balls, if other bearings are needed, such that all bearings wear uniformly when wearing in normal motor service. Bearings 3*a*, 3*b*, and 3*c* run in races 10*a*, 10*b*, and 10*c* respectively, which are integral with sleeve 10. Tension forces applied to tools, such as drill bits, (not shown) by a drill string do not need to load nut 16 and, hence, do not need to load the weaker upper end of the output shaft 11. Tension forces from an attached drill string pass through housing 1, lower bearing housing 7, through juncture 6 to race stack 2, into balls 3*a*-3*c* to sleeve 10 and to the extended output shaft at threads 9. A drill bit is usually attached to tool joint box 13, or the equivalent. Fluid flow through channel 12 usually has powered the motor and usually exits through jets in the bit (not shown).

Shock committed bearings are those that run in races integral with sleeve 10. In some cases, the committed bearings are adequate to function as the total of bearings needed for normal motor function.

The description of three committed bearings is not to be construed in a limiting sense. It is preferred that the bearing stack committed to shaft security should not be the weakest link in the stressed assembly. The number of bearings committed may vary accordingly, depending upon the specific motor so protected.

Figure 6:
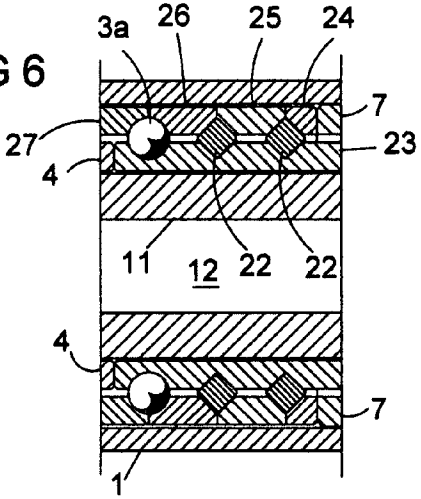
FIG. 6 is a fragmented side view of a selected area of the embodiment with an alternate, optional, feature.

Bearing ball sets 3*a*, 3*b*, and 3*c*, can be replaced by non-rolling friction bearing elements. Such an arrangement is shown by FIG. 6.

Figure 3:
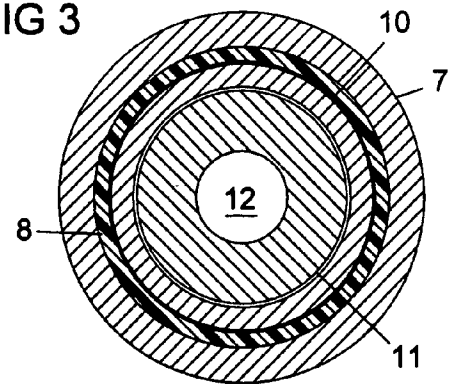
FIG. 3 is a section taken along line 3-3.

FIG. 3 shows a composite radial bearing 8 in lower bearing housing 7, supporting sleeve 10 which axially secures output shaft 11 within the general motor housing.

Figure 4:
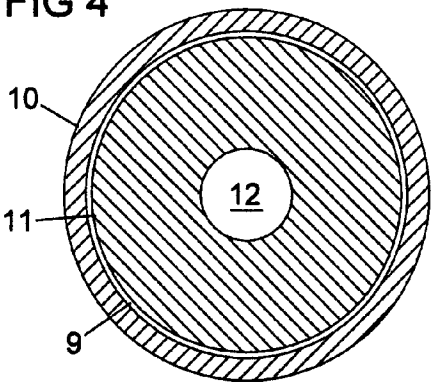
FIG. 4 is a section taken along line 4-4.

FIG. 4 shows sleeve 10 secured to output shaft 11 by threads 9.

Figure 5:
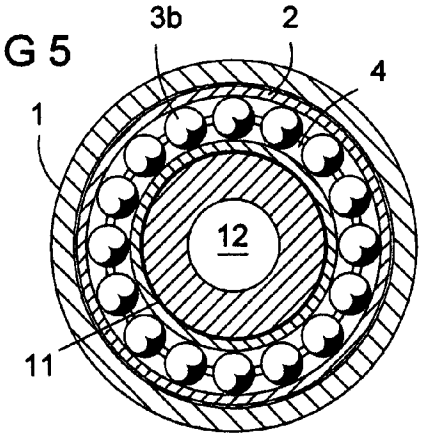
FIG. 5 is a section taken along line 5-5.

FIG. 5 shows the bearings generally labeled 3*b*, running in races of race stacks 2 and 4, situated on shaft 111 and within housing 1. The section is taken through bearing set 3*b* (balls not sectioned), taken along line 3-3.

FIG. 6 shows bearing housing 7 compressing races 24-27. One bearing set 3*a* is retained in a ball form. Two ball bearings are replaced by friction bearing rings 22. The friction bearings are rings of diamond shaped section. The sleeve 10 has been replaced by a sleeve 23 adapted to accept the bearing rings 22. Rings 22 consist of two arcuate components that comprise a complete ring when installed. Race components 24, 25, and 26 are complete rings. When the races are compressed axially, the friction ring can freely rotate independently of the races. The friction bearings accept shock loads with less damage than experienced with bearing balls alone.

Figure 7:
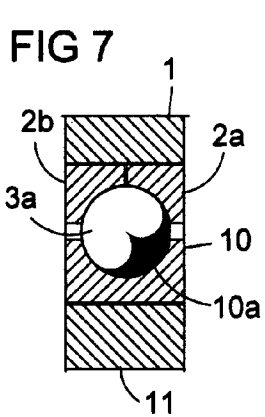
FIG. 7 is a section, rather enlarged, through one bearing ball and related races.

FIG. 7 shows ball 3*a* captured in a groove 10*a* in sleeve 10, secured by races 2*a* and 2*b* of race assembly 2. This arrangement enables installation of the ball sets.

Figure 8:
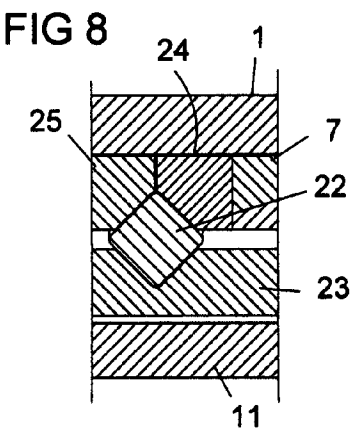
FIG. 8 is similar to FIG. 7 but showing an alternate bearing form.

FIG. 8, an enlarged fragment of FIG. 6, shows the alternate bearing element 22 captured by races 24 and 25 which are compressed in place in housing 1 by bearing housing 7.

From the foregoing, it will be seen that this invention is one well adapted to attain all of the ends and objects hereinabove set forth, together with other advantages which are obvious and which are inherent to the apparatus.

It will be understood that certain features and sub-combinations are of utility and may be employed without reference to other features and sub-combinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

We claim:

1. A down hole drilling motor apparatus with an output shaft secured to a general housing by bearings directly connecting the general housing to the extending portion of the output shaft, the apparatus comprising:

a) a down hole motor with said general housing, said output shaft, and a first bearing assembly to secure the output shaft within the general housing;

b) an intermediate sleeve threadedly attached to an enlarged extending portion of the output shaft; and c) a second bearing assembly arranged to transmit at least axial forces between said general housing and said intermediate sleeve.

2. The apparatus of claim 1 wherein rolling elements in said second bearing assembly are situated to run in races integral with said intermediate sleeve.

3. The apparatus of claim 1 wherein said second bearing assembly comprises at least one ball bearing.

4. The apparatus of claim 1 wherein said second bearing assembly comprises at least one friction thrust bearing component that is free to revolve, relative to both housing and output shaft, about the axis of rotation of the output shaft.

5. The apparatus of claim 1 wherein said second bearing comprises outer races divided by a plane that includes the centers of balls running in the races.

6. The apparatus of claim 1 wherein said intermediate sleeve is said threadedly attached to said output shaft outside said general housing.

7. A down hole drilling motor apparatus with an output shaft secured to a general housing by bearings directly connecting the general housing to a portion of the output shaft extending from the general housing, the apparatus comprising:

a) a down hole motor with said general housing, and said output shaft;

b) an intermediate sleeve threadedly attached to said portion of the output shaft; and c) a bearing assembly arranged to transmit at least axial forces between said general housing and said intermediate sleeve.

8. The apparatus of claim 7 wherein said bearing assembly comprises rolling elements.

9. The apparatus of claim 7 wherein said bearing assembly comprises at least one friction thrust bearing component that is free to revolve, relative to both housing and output shaft, about the axis of rotation of the output shaft.

* * * * *